US010969714B1

(12) United States Patent
Usami

(10) Patent No.: US 10,969,714 B1
(45) Date of Patent: Apr. 6, 2021

(54) IMAGE FORMING APPARATUS CONFIGURED TO SET DIFFERENT TARGET HEATER TEMPERATURES DURING PRINTING

(71) Applicant: TOSHIBA TEC KABUSHIKI KAISHA, Tokyo (JP)

(72) Inventor: Yutaka Usami, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/570,486

(22) Filed: Sep. 13, 2019

(51) Int. Cl.
*G03G 15/20* (2006.01)
*G03G 15/00* (2006.01)

(52) U.S. Cl.
CPC ..... *G03G 15/205* (2013.01); *G03G 15/5004* (2013.01)

(58) Field of Classification Search
None
See application file for complete search history.

(56) References Cited

U.S. PATENT DOCUMENTS 6,038,412 A * 3/2000 Hiraoka ..... G03G 15/205 118/60
2008/0069584 A1* 3/2008 Sanada ..... G03G 15/2039 399/88
2017/0023891 A1* 1/2017 Otsuka ..... G03G 15/205
2017/0185016 A1 6/2017 Kadowaki

FOREIGN PATENT DOCUMENTS

JP 2016136225 A 7/2016

* cited by examiner

*Primary Examiner* — Victor Verbitsky
(74) *Attorney, Agent, or Firm* — Kim & Stewart LLP

(57) ABSTRACT

An image forming apparatus includes a heat roller comprising a heater and configured to generate heat to fix a toner image on a print medium, a system controller configured to transmit, when printing is performed on a print medium, a control signal that indicates when power is to be supplied to the heater, and a heater control circuit configured to control amount of power supplied to the heater according to the control signal, a target temperature of the heater, and a current temperature of the heater. When printing is to be continuously performed on a plurality of print media, the system controller transmits the control signal to the heater control circuit a first predetermined time before start of printing.

14 Claims, 5 Drawing Sheets

IMAGE FORMING APPARATUS CONFIGURED TO SET DIFFERENT TARGET HEATER TEMPERATURES DURING PRINTING

FIELD

Embodiments described herein relate generally to an image forming apparatus and a control method of the image forming apparatus.

BACKGROUND

An image forming apparatus performs an image forming process of receiving a toner from a toner cartridge and forming a toner image on a photosensitive drum. The image forming apparatus transfers the toner image formed on the photosensitive drum to a print medium. The image forming apparatus fixes the toner image to the print medium by applying heat and pressure to the print medium by a fixing device including a heat roller and a press roller. As such, an image is formed on the print medium. In order to reduce unevenness of the image printed on the print medium, the surface temperature of the heat roller needs to be kept constant.

The image forming apparatus causes the heater to heat the heat roller to a predetermined temperature. However, there is a time lag until heat is transferred from the heater to the surface of the heat roller. For example, the image forming apparatus may perform intermittent paper feeding (for example, initially feeding 10 sheets of paper, and after a predetermined interval, feeding 10 more sheets of paper). In such a case, even if the heater is turned off after the completion of the first paper feeding, no paper is fed during the interval, and thus, the temperature of the heat roller rises due to residual heat of the heater. After the interval, the image forming apparatus turns on the heater and paper is fed, again. However, when heat is transferred from the heat roller to the print medium while the heat from the heater is not sufficient (e.g., immediately after the start-up of the heater), the temperature of the surface of the heat roller decreases and temperature fluctuation of the surface of the heat roller surface becomes large. As such, since the temperature of the surface of the heat roller cannot be instantaneously controlled, it is difficult to keep the temperature of the surface of the heat roller constant.

DETAILED DESCRIPTION

According to one embodiment, an image forming apparatus includes a heat roller comprising a heater configured to generate heat to fix a toner image on a print medium, a system controller configured to transmit, when printing is performed on a print medium, a control signal that indicates when power is to be supplied to the heater, and a heater control circuit configured to control amount of power supplied to the heater according to the control signal, a target temperature of the heater, and a current temperature of the heater. When printing is to be continuously performed on a plurality of print media, the system controller transmits the control signal to the heater control circuit a first predetermined time before start of printing.

Hereinafter, an image forming apparatus and a control method of the image forming apparatus according to an embodiment will be described with reference to the drawings.

Figure 1:
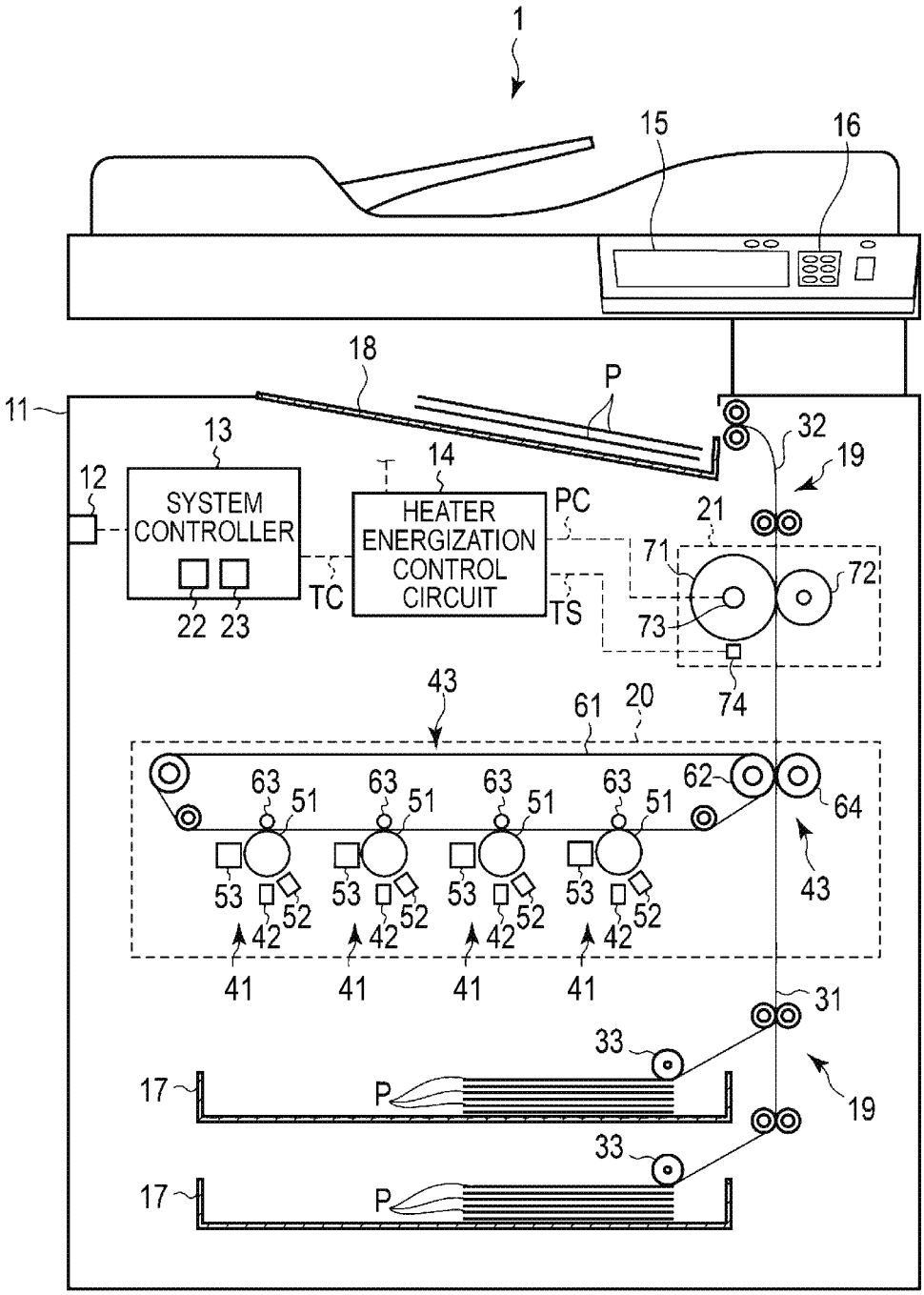
FIG. 1 is a diagram illustrating a configuration of an image forming apparatus according to an embodiment.

FIG. 1 is an explanatory diagram illustrating a configuration of an image forming apparatus 1 according to an embodiment.

The image forming apparatus 1 is, for example, a multifunction printer (MFP) that performs various processing such as image formation while conveying a recording medium such as a print medium. The image forming apparatus 1 is, for example, a solid-state scanning type printer (for example, an LED printer) that scans with an LED array and performs various processing such as image formation while conveying a recording medium such as a print medium.

For example, the image forming apparatus 1 receives a toner from a toner cartridge and form an image on the print medium using the received toner. For example, the toner may be a single color toner or color toners, such as cyan, magenta, yellow, and black. The toner may be a decolorable toner which is decolored when the toner is heated to a predetermined temperature.

As illustrated in FIG. 1, the image forming apparatus 1 includes a casing 11, a communication interface 12, a system controller 13, a heater energization control circuit 14, a display unit 15, an operation interface 16, a plurality of paper trays 17, a paper discharge tray 18, a conveyance unit 19, an image forming unit 20, and a fixing device 21.

The casing 11 is a main body of the image forming apparatus 1. The casing 11 accommodates the communication interface 12, the system controller 13, the heater energization control circuit 14, the display unit 15, the operation interface 16, the plurality of paper trays 17, the paper discharge tray 18, the conveyance unit 19, the image forming unit 20, and the fixing device 21.

First, a configuration of a control system of the image forming apparatus 1 will be described.

The communication interface 12 is an interface for communicating with another device. The communication interface 12 is used, for example, for communication with a host device. For example, the communication interface 12 is an ethernet adaptor to which a LAN connector is connectable. The communication interface 12 may perform wireless communication with another device according to standards such as Bluetooth (registered trademark) or Wi-fi (registered trademark).

The system controller 13 controls the image forming apparatus 1. The system controller 13 includes, for example, a processor 22 and a memory 23.

The processor 22 is a processing unit that executes various processing. The processor 22 is, for example, a CPU. The processor 22 performs various functions by executing one or more programs stored in the memory 23.

The memory 23 is a memory device storing programs and data used by the programs. The memory 23 also functions as a working memory. That is, the memory 23 temporarily stores data being processed by the processor 22.

The processor 22 performs various information processing by executing the program stored in the memory 23. The processor 22 generates a print job based on, for example, an image acquired from an external device via the communication interface 12. The processor 22 stores the generated print job in the memory 23.

The print job includes image data indicating an image to be formed on a print medium P. The image data may be data for forming the image on one print medium P, or may be data for forming the image on a plurality of print media P. The print job includes information indicating whether color printing or monochrome printing is to be performed. The print job may include information such as the number of printed copies and the number of printed sheets (i.e., the number of pages) per copy.

The processor 22 generates a print control signal TC for controlling the operation of the conveyance unit 19, the image forming unit 20, and the fixing device 21 based on the generated print job. The print control signal TC indicates the timing of continuous paper feeding and the timing of an interval when continuous paper feeding is interrupted. In the continuous paper feeding printing is continuously performed on a plurality of print media P. The interval indicates a temporal gap after the continuous paper feeding. The processor 22 supplies the print control signal TC to the heater energization control circuit 14.

The processor 22 executes the program stored in the memory 23 to control the operation of the conveyance unit 19 and the image forming unit 20. That is, the processor 22 controls conveyance of the print medium P by the conveyance unit 19 and formation of an image on the print medium P by the image forming unit 20.

The image forming apparatus 1 may include an engine controller, which controls the operation of the conveyance unit 19 and the image forming unit 20, separately from the system controller 13. In this case, the system controller 13 supplies information necessary for control in the engine controller thereto.

The image forming apparatus 1 includes a power conversion circuit (not illustrated) that supplies a DC voltage to various components in the image forming apparatus 1 using an AC voltage of an AC power supply AC. The power conversion circuit supplies a DC voltage necessary for the operation of the processor 22 and the memory 23 to the system controller 13. The power conversion circuit also supplies a DC voltage necessary for image formation to the image forming unit 20. The power conversion circuit supplies a DC voltage necessary for conveyance of the print medium to the transport unit 19.

The heater energization control circuit 14 controls energization to the heater of the fixing unit 21. The heater energization control circuit 14 generates energization power PC for energizing the heater of the fixing device 21 using the AC voltage of the AC power supply AC, and supplies the generated energization power PC to the heater of the fixing device 21. Detailed description of the heater energization control circuit 14 will be described later.

The display unit 15 includes a display for displaying a screen according to a video signal input from the system controller 13 or a display control unit such as a graphic controller (not illustrated). For example, a screen for various settings of the image forming apparatus 1 is displayed on the display unit 15.

The operation interface 16 is connected to operation keys or buttons. The operation interface 16 supplies an operation signal to the system controller 13 according to an input made via the operation keys or buttons. The operation keys or buttons include, for example, a touch sensor, a number key, a power key, a paper feed key, various function keys, and a keyboard. The touch sensor acquires information indicating a designated position in a certain area. The touch sensor is configured integrally as a touch panel with the display unit 15 to allow a signal indicating a touched position on the screen displayed on the display unit 15 to be input to the system controller 13.

The plurality of paper trays 17 are cassettes for storing the print media P. The print medium P is supplied from the outside of the casing 11 to the paper tray 17. For example, the paper tray 17 is configured to be able to be pulled out from the casing 11.

The paper discharge tray 18 is a tray for holding the print medium P discharged from the image forming apparatus 1.

Next, a configuration for conveying the print medium P of the image forming apparatus 1 will be described.

The conveyance unit 19 is a mechanism for conveying the print medium P in the image forming apparatus 1. As illustrated in FIG. 1, the conveyance unit 19 includes a plurality of conveyance paths. For example, the conveyance unit 19 includes a paper feeding path 31 and a paper discharging path 32.

Along each of the paper feeding path 31 and the paper discharging path 32, a plurality of motors, a plurality of rollers, and a plurality of guides are installed (not illustrated). The plurality of motors rotates a shaft based on control of the system controller 13 to rotate rollers interlocked with the shaft. The plurality of rollers rotates to move the print medium P. The plurality of guides controls a conveyance direction of the print medium P.

The print medium P is picked up from the paper tray 17 and supplied to the image forming unit 20 along the paper feeding path 31. The paper feeding path 31 includes pickup rollers 33 corresponding to the respective paper trays. Each pickup roller 33 picks up the print medium P from the paper tray 17 and supplies it to the paper feeding path 31.

The paper discharging path 32 is a conveyance path for discharging the print medium P on which an image is formed from the casing 11. The print medium P discharged by the discharging path 32 is held by the paper discharge tray 18.

Next, the image forming unit 20 will be described.

The image forming unit 20 is configured to form an image on the print medium P. Specifically, the image forming unit 20 forms the image on the print medium P based on the print job generated by the processor 22.

The image forming unit 20 includes a plurality of process units 41, a plurality of exposure devices 42, and a transfer mechanism 44. The image forming unit 20 includes the exposure device 42 for each process unit 41. Since the plurality of process units 41 and the plurality of exposure device 42 have the same configuration, one process unit 41 and one exposure device 42 will be described.

First, the process unit 41 will be described.

The process unit 41 is configured to form a toner image on the print medium P. For example, each of the plurality of process units 41 is provided for each type of toner. For example, the plurality of process units 41 corresponds to respective color toners such as cyan, magenta, yellow, and black. Specifically, the process units 41 are connected with toner cartridges including respective toners of different colors.

The toner cartridge includes a toner storage container and a toner delivery mechanism. The toner storage container is a container for storing toner. The toner delivery mechanism is a delivery mechanism such as a screw for delivering the toner in the toner storage container.

The process unit 41 includes a photosensitive drum 51, a charger 52, and a developing device 53.

The photosensitive drum 51 is a photosensitive body including a cylindrical drum and a photosensitive layer formed on the outer circumferential surface of the drum. The photosensitive drum 51 is rotated at a constant speed by a drive mechanism (not illustrated).

The charger 52 uniformly charges the surface of the photosensitive drum 51. For example, the charger 52 applies a voltage (i.e., developing bias voltage) to the photosensitive drum 51 using a charging roller to charge the photosensitive drum 51 to uniform negative potential (i.e., contrast potential). The charging roller is rotated by rotation of the photosensitive drum 51 when a predetermined pressure is applied to the photosensitive drum 51. The contrast potential changes according to strength of the developing bias voltage. That is, the developing bias voltage and the contrast potential are, in other words, charging intensity of the photosensitive drum 51.

The developing device 53 is a device that causes the toner to adhere to the photosensitive drum 51. The developing device 53 includes a developer container, a stirring mechanism, a developing roller, a doctor blade, an automatic toner control (ATC) sensor, and the like.

The developer container is a container for receiving and storing the toner delivered from the toner cartridge. A carrier is stored in advance in the developer container. The toner delivered from the toner cartridge is mixed with the carrier by the stirring mechanism, and thereby forms a developer. The carrier is stored in the developer container when the developing device 53 is manufactured.

The developing roller causes the developer to adhere to the surface by rotating in the developer container. The doctor blade is disposed at a predetermined distance from the surface of the developing roller. The doctor blade removes a part of developer adhered to the surface of the rotating developing roller. Therefore, a layer of developer having a thickness corresponding to a distance between the doctor blade and the surface of the developing roller is formed on the surface of the developing roller.

The ATC sensor is, for example, a magnetic flux sensor including a coil and detecting a voltage value generated in the coil. The detection voltage of the ATC sensor changes depending on the density of the magnetic flux from the toner in the developer container. That is, the system controller 13 can determine a concentration ratio of the toner remaining in the developer container to the carrier based on the detection voltage of the ATC sensor. The system controller 13 operates a motor (not illustrated) for driving the delivery mechanism of the toner cartridge based on the toner concentration ratio to deliver the toner from the toner cartridge to the developer container of the developing device 53.

Next, the exposure device 42 will be described.

The exposure device 42 includes a plurality of light emitting elements. The exposure device 42 forms a latent image on the photosensitive drum 51 by irradiating the charged photosensitive drum 51 with light from the light emitting element. The light emitting element is, for example, a light emitting diode (LED) or the like. One light emitting element is configured to emit light to one point on the photosensitive drum 51. The plurality of light emitting elements is arranged in the main scanning direction which is a direction parallel to a rotation axis of the photosensitive drum 51.

The exposure device 42 irradiates the photosensitive drum 51 with light by the plurality of light emitting elements arranged in the main scanning direction based on the input image data, thereby forming a latent image of one line on the photosensitive drum 51. The exposure device 42 continuously irradiates the rotating photosensitive drum 51 with light to form a latent image of a plurality of lines.

In the configuration described above, when the surface of the photosensitive drum 51 charged by the charger 52 is irradiated with light from the exposure device 42, an electrostatic latent image is formed. When the developer layer formed on the surface of the developing roller approaches the surface of the photosensitive drum 51, the toner contained in the developer adheres to the latent image formed on the surface of the photosensitive drum 51. Therefore, a toner image is formed on the surface of the photosensitive drum 51.

Next, the transfer mechanism 43 will be described.

The transfer mechanism 43 is configured to transfer the toner image formed on the surface of the photosensitive drum 51 to the print medium P.

The transfer mechanism 43 includes, for example, a primary transfer belt 61, a secondary transfer counter roller 62, a plurality of primary transfer rollers 63, and a secondary transfer roller 64.

The primary transfer belt 61 is an endless belt wound around the secondary transfer counter roller 62 and a plurality of winding rollers. The primary transfer belt 61 includes an inner surface (i.e., inner circumferential surface) in contact with the secondary transfer counter roller 62 and the plurality of winding rollers, and an outer surface (i.e., outer circumferential surface) facing the photosensitive drum 51 of the process unit 41.

The secondary transfer counter roller 62 is rotated by a motor (not illustrated). The secondary transfer counter roller 62 rotates to convey the primary transfer belt 61 in a predetermined conveyance direction. The plurality of winding rollers is configured to be freely rotatable. The plurality of winding rollers rotates according to the movement of the primary transfer belt 61 by the secondary transfer counter roller 62.

The plurality of primary transfer rollers 63 are configured to bring the primary transfer belt 61 into contact with the photosensitive drums 51 of the process unit 41. The plurality of primary transfer rollers 63 is provided to correspond to the respective photosensitive drums 51 of the plurality of process units 41. Specifically, the plurality of primary transfer rollers 63 are provided at positions facing the photosensitive drums 51 of the corresponding process units 41 with the primary transfer belt 61 interposed therebetween. The primary transfer roller 63 contacts the inner circumferential surface side of the primary transfer belt 61 and displaces the primary transfer belt 61 to the photosensitive drum 51. Therefore, the primary transfer roller 63 brings the outer circumferential surface of the primary transfer belt 61 into contact with the photosensitive drum 51.

The secondary transfer roller 64 is provided at a position facing the primary transfer belt 61. The secondary transfer roller 64 contacts the outer circumferential surface of the primary transfer belt 61 and applies pressure to the outer circumferential surface. Therefore, a transfer nip is formed in which the secondary transfer roller 64 and the outer circumferential surface of the primary transfer belt 61 are in close contact with each other. When the print medium P passes through the transfer nip, the secondary transfer roller 64 presses the print medium P passing through the transfer nip against the outer circumferential surface of the primary transfer belt 61.

The secondary transfer roller 64 and the secondary transfer counter roller 62 rotate to convey the print medium P supplied from the paper feeding path 31 in a sandwiched state. Therefore, the print medium P passes through the transfer nip.

In the configuration described above, when the outer circumferential surface of the primary transfer belt 61 contacts the photosensitive drum 51, the toner image formed on the surface of the photosensitive drum is transferred to the outer circumferential surface of the primary transfer belt 61. When the image forming unit 20 includes the plurality of process units 41, the primary transfer belt 61 receives the toner image from the photosensitive drums 51 of the plurality of process units 41. The toner image transferred to the outer circumferential surface of the primary transfer belt 61 is conveyed by the primary transfer belt 61 to the transfer nip in which the secondary transfer roller 64 and the outer circumferential surface of the primary transfer belt 61 are in close contact with each other. When the print medium P is present in the transfer nip, the toner image transferred to the outer circumferential surface of the primary transfer belt 61 is transferred to the print medium P in the transfer nip.

Next, a configuration of the image forming apparatus 1 for fixing a toner image will be described.

The fixing device 21 fixes the toner image transferred from the primary transfer belt 61 on the print medium P. The fixing device 21 operates based on the control of the system controller 13. The fixing device 21 includes a heating member that applies heat to the print medium P and a pressure member that applies pressure to the print medium P. For example, the heating member is a heat roller 71. For example, the pressure member is a press roller 72. The fixing device 21 includes a heater 73 for heating the heat roller 71 and a temperature sensor 74 for detecting the temperature of the surface of the heat roller 71.

The heat roller 71 is a rotating body for fixing, which is rotated by a motor (not illustrated). The heat roller 71 includes a hollow-shaped core formed of metal, and an elastic layer formed on the outer circumference of the core. In the heat roller 71, the inside of the hollow-shaped core is heated by the heater 73 disposed inside the core. The heat generated inside the core is transferred to the surface of the heat roller 71 (that is, the outside surface of the elastic layer).

The heater 73 is a device that generates heat by the energization power PC supplied from the heater energization control circuit 14. The heater 73 is, for example, a halogen heater. The heater 73 causes the inside of the core of the heat roller 71 to generate heat by electromagnetic waves emitted from the halogen lamp heater. The halogen lamp heater is energized by the energizing power PC supplied from the heater energization control circuit 14.

The temperature sensor 74 detects the temperature of the surface of the heat roller 71. The temperature sensor 74 detects the temperature of air around the heat roller 71. The temperature sensor 74 may be provided at a position at which at least a change in the temperature of the heat roller 71 can be detected. The temperature sensor 74 supplies a temperature detection signal TS indicating the detection result to the heater energization control circuit 14.

The press roller 72 is provided at a position facing the heat roller 71. The press roller 72 includes a core made of metal with a predetermined outer diameter and an elastic layer formed on the outer circumference of the core. The press roller 72 applies pressure to the heat roller 71 by stress applied from a tension member (not illustrated). By applying pressure from the press roller 72 to the heat roller 71, a fixing nip in which the press roller 72 and the heat roller 71 are in close contact with each other is formed. The press roller 72 is rotated by a motor (not illustrated). The press roller 72 rotates to move the print medium P entering the fixing nip and press the print medium P against the heat roller 71.

With the configuration described above, the heat roller 71 and the press roller 72 apply heat and pressure to the print medium P passing through the fixing nip. The toner on the print medium P is melted by heat applied from the heat roller 71, and is applied to the surface of the print medium P by heat and pressure applied by the heat roller 71 and the press roller 72. As a result, the toner image is fixed on the print medium P passing through the fixing nip. The print medium P passing through the fixing nip is introduced into the paper discharging path 32 and is discharged to the outside of the casing 11.

Next, the heater energization control circuit 14 will be described.

The heater energization control circuit 14 controls energization to the heater 73 of the fixing device 21. The heater energization control circuit 14 generates energization power PC for energizing the heater 73 of the fixing device 21 using the AC voltage of the AC power supply AC, and supplies the generated energization power PC to the heater 73 of the fixing device 21. The heater energization control circuit 14 controls the timing for energizing the heater 73 of the fixing device 21 by the energization power PC based on (i) the print control signal TC supplied from the system controller 13 and (ii) the temperature detection signal TS indicating the temperature detection result of the surface of the heat roller 71 supplied from the temperature sensor 74.

Figure 2:
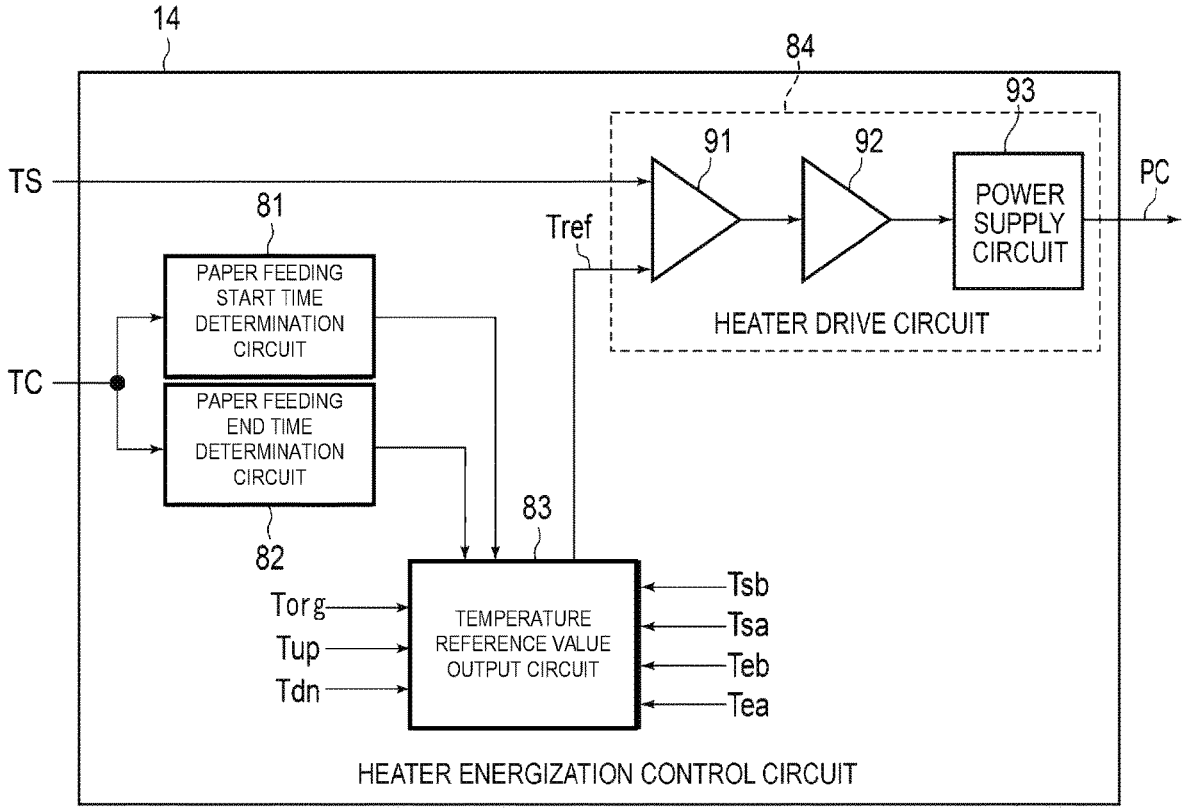
FIG. 2 is a diagram illustrating configuration of a heater energization control circuit according to the embodiment.

As illustrated in FIG. 2, the heater energization control circuit 14 includes a paper feeding start time determination circuit 81, a paper feeding end time determination circuit 82, a temperature reference value output circuit 83, and a heater drive circuit 84.

The heater energization control circuit 14 includes a memory (not illustrated) that stores a reference temperature Torg, a first temperature setting Tup, a second temperature setting Tdn, a first time setting Tsb, a second time setting Tsa, a third time setting Teb, and a fourth time setting Tea. The reference temperature Torg, the first temperature setting Tup, and the second temperature setting Tdn are values indicating temperatures set in advance. The first time setting Tsb, the second time setting Tsa, the third time setting Teb, and the fourth time setting Tea are values indicating time periods set in advance. The reference temperature Torg, the first temperature setting Tup, the second temperature setting Tdn, the first time setting Tsb, the second time setting Tsa, the third time setting Teb, and the fourth time setting Tea are input to the target value output circuit 83.

The temperature reference value output circuit 83 may include a memory in which the reference temperature Torg, the first temperature setting Tup, the second temperature setting Tdn, the first time setting Tsb, the second time setting Tsa, the third time setting Teb, and the fourth time setting Tea are stored. The temperature reference value output circuit 83 may receive the reference temperature Torg, the first temperature setting Tup, the second temperature setting Tdn, the first time setting Tsb, the second time setting Tsa, the third time setting Teb, and the fourth time setting Tea from an external circuit or device such as the system controller 13.

The paper feeding start time determination circuit 81 determines the time when paper feeding starts (i.e., paper feeding start time) based on the print control signal TC supplied from the system controller 13, and supplies the paper feeding start time to the temperature reference value output circuit 83. For example, the paper feeding start time determination circuit 81 determines the timing when the continuous paper feeding is started based on the print control signal TC. Specifically, the paper feeding start time determination circuit 81 determines the timing when the leading print medium P of continuous paper feeding reaches the fixing nip formed by the heat roller 71 and the press roller 72 of the fixing device 21 as the timing when the continuous paper feeding is started.

The paper feeding end time determination circuit 82 determines the time when paper feeding ends (i.e., paper feeding end time) based on the print control signal TC supplied from the system controller 13, and supplies the paper feeding end time to the temperature reference value output circuit 83. For example, the paper feeding end time determination circuit 82 determines the timing when the continuous paper feeding ends based on the print control signal TC. Specifically, the paper feeding end time determination circuit 82 determines the timing when the last print medium P of continuous paper feeding has passed through the fixing nip formed by the heat roller 71 and the press roller 72 of the fixing device 21 as the timing when the continuous paper feeding ends.

The temperature reference value output circuit 83 is a circuit that outputs a temperature reference value Tref which is a target value of the surface temperature of the heat roller 71. The temperature reference value Tref is a target value of the surface temperature of the heat roller 71 of the fixing device 21. The heater energization control circuit 14 controls energization to the heater 73 so that the temperature reference value Tref and the temperature detection signal TS become equal.

The temperature reference value output circuit 83 outputs the temperature reference value Tref to the heater drive circuit 84 based on the paper feeding start time, the paper feeding end time, the reference temperature Torg, the first temperature setting Tup, the second temperature setting Tdn, the first time setting Tsb, and the second time setting Tsa, the third time setting Teb, and the fourth time setting Tea.

The heater drive circuit 84 is a circuit that supplies energization power to the heater 73 to drive the heater 73 based on the temperature detection signal TS and the temperature reference value Tref. The heater drive circuit 84 includes a difference detection circuit 91, a PID control circuit 92, and a power supply circuit 93.

The temperature reference value Tref and the temperature detection signal TS are input to the difference detection circuit 91. The difference detection circuit 91 outputs a difference DF between the temperature reference value Tref and the temperature detection signal TS to the PID control circuit 92.

The PID control circuit 92 is a filter for providing feedback to the power supply circuit 93 by adjusting values of a proportional term P, an integral term I, and a derivative term D based on the difference DF input from the difference detection circuit 91. The PID control circuit 92 performs PID control on the difference DF, and outputs the result (i.e., control amount PID) to the power supply circuit 93. A main computational effect of PID control is derivation. That is, the PID control circuit 92 provides negative feedback to the power supply circuit 93 so that the actual temperature value matches the temperature reference value Tref.

The power supply circuit 93 is a circuit for energizing the heater 73 of the fixing device 21 by using the AC voltage of the AC power supply AC. The AC voltage of the AC power supply AC and the control amount PID which is an output of the PID control circuit 92 are input to the power supply circuit 93. The power supply circuit 93 generates the energization power PC for energizing the heater 73 of the fixing device 21 based on the control amount PID using the AC voltage of the AC power supply AC. That is, the power supply circuit 93 generates the energization power PC according to the control amount PID, and supplies the generated energization power PC to the heater 73 to heat the heat roller 71 of the fixing device 21.

For example, the output from the PID control circuit 92 is a duty ratio that ranges from 0% to 100% corresponding to 0V to 1V, and the power supply circuit 93 supplies power to the heater 73 according to the duty cycle. For example, when the duty ratio is 100%, the power supply circuit 93 supplies power to the heater 73 using all the cycles of the AC voltage from the AC power supply AC. For example, when the duty ratio is 50%, the power supply circuit 93 thins out the cycles of the AC voltage from the AC power supply AC to half (i.e., using 50 cycles among 100 cycles), and supplies power to the heater 73. For example, when the duty ratio is 33%, the power supply circuit 93 thins out the cycles of the AC voltage from the AC power supply AC to one-third (i.e., using 33 cycles among 100 cycles), and supplies power to the heater 73. That is, the power supply circuit 93 switches between conduction and non-conduction in units of cycles when the phase of the AC voltage is zero based on the temperature detection signal TS and the temperature reference value Tref, and controls the energization power PC.

The power supply circuit 93 may be configured to adjust the power to be supplied to the heater 73 by controlling the phase angle according to the control amount PID within one cycle. For example, when the duty ratio is 100%, the power supply circuit 93 supplies power to the heater 73 using all of one cycle of the AC voltage from the AC power supply AC. For example, when the duty ratio is 50%, the power supply circuit 93 thins out the phases within one cycle of the AC voltage from the AC power supply AC to half (i.e., using half of the phases among one cycle), and supplies power to the heater 73. For example, when the duty ratio is 33%, the power supply circuit 93 thins out the phases within one cycle of the AC voltage from the AC power supply AC to one-third (i.e., using one-third of the phases among one cycle), and supplies power to the heater 73. That is, the power supply circuit 93 conducts energization from the timing when the phase of the AC voltage is zero and controls the phase angle until switching to non-conduction based on the temperature detection signal TS and the temperature reference value Tref, thereby controlling the energization power PC.

Next, the operation of temperature reference value output circuit 83 will be described.

Figure 3:
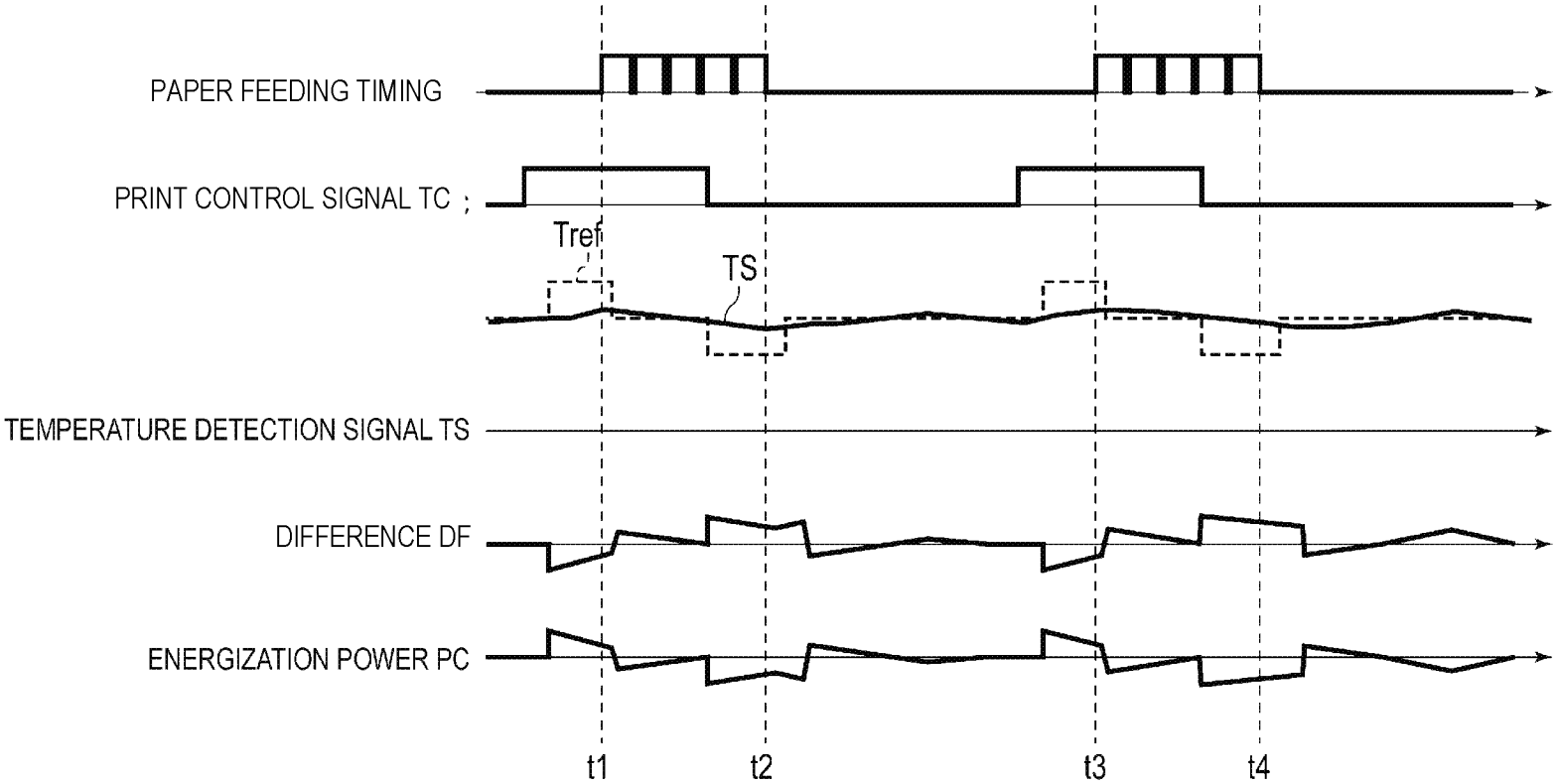
FIG. 3 is a view illustrating an operation of the heater energization control circuit.
Figure 4:
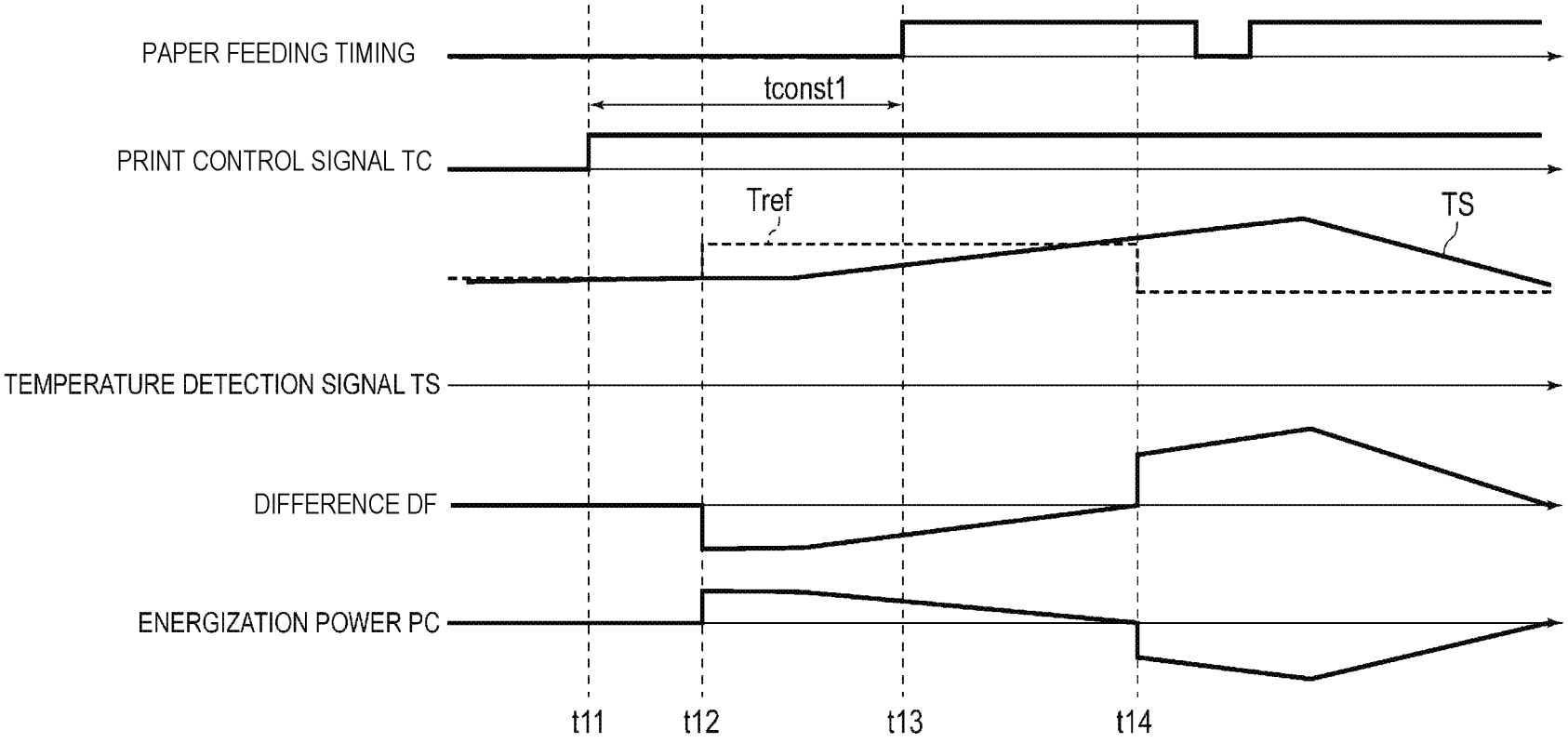
FIG. 4 is a view illustrating the operation of the heater energization control circuit.
Figure 5:
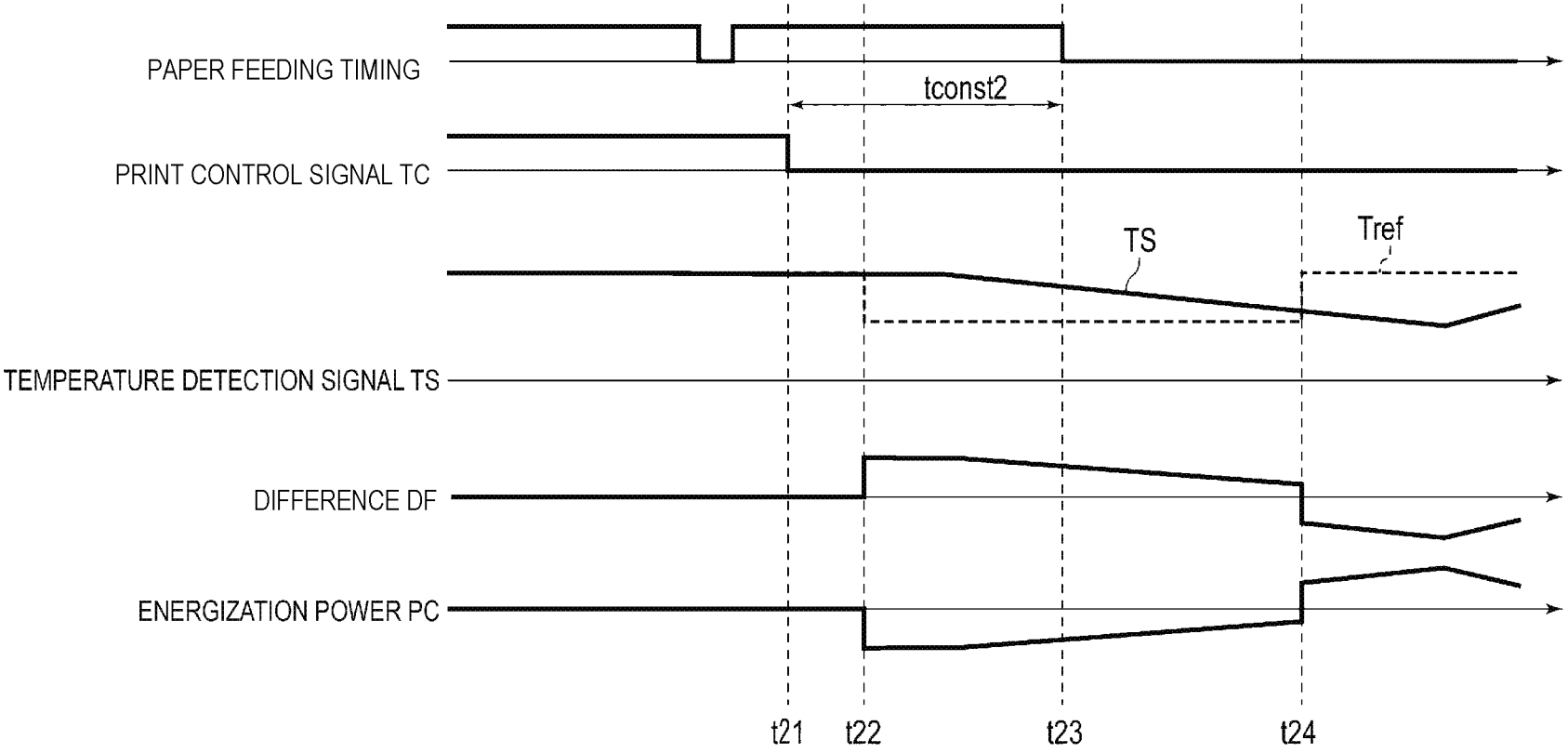
FIG. 5 is a view illustrating the operation of the heater energization control circuit.

FIGS. 3 to 5 are explanatory diagrams illustrating the operation of the temperature reference value output circuit 83. FIGS. 3 to 5 illustrates the relationships between the paper feeding timing, the print control signal TC, the temperature detection signal TS, the difference DF which is the output of the difference detection circuit 91, and the energization power PC, in continuous paper feeding. FIG. 3 is a view illustrating the relationship between plurality of continuous paper feeding and intervals. FIG. 4 is a view illustrating the relationship when the continuous paper feeding is started. FIG. 5 is a view illustrating the relationship when the continuous paper feeding ends.

In the example of FIG. 3, the continuous paper feeding starts at timing t1, the continuous paper feeding ends at timing t2, the continuous paper feeding starts at timing t3, and the continuous paper feeding ends at timing t4. That is, a temporal gap between the timing t2 and the timing t3 indicates an interval.

The print control signal TC is set to the H level by the system controller 13 a predetermined time (i.e., time tconst1) before the timing when the continuous paper feeding is started. That is, the timing t1 and the timing t3 when the continuous paper feeding is started can be determined based on the print control signal TC and the time tconst1. The print control signal TC is set to the L level by the system controller 13 a predetermined time (tconst2) before the timing when the continuous paper feeding ends. That is, the timing t2 and the timing t4 when the continuous paper feeding ends can be determined based on the print control information TC and the time tconst2.

Specifically, the paper feeding start time determination circuit 81 of the heater energization control circuit 14 determines the paper feeding start time when paper feeding is started, based on the timing when the print control signal TC changes from the L level to the H level, and supplies the determined paper feeding start time to the temperature reference value output circuit 83. That is, the paper feeding start time determination circuit 81 supplies information indicating the timing t1 and the timing t3 to the temperature reference value output circuit 83. The paper feeding end time determination circuit 82 of the heater energization control circuit 14 determines the paper feeding end time when the paper feeding ends, based on the timing when the print control signal TC changes from the H level to the L level, and supplies the determined paper feeding end time to the temperature reference value output circuit 83. That is, the paper feeding end time determination circuit 82 supplies information indicating the timing t2 and the timing t4 to the temperature reference value output circuit 83.

The temperature reference value output circuit 83 outputs the temperature reference value Tref to the difference detection circuit 91 based on the paper feeding start time, the paper feeding end time, the reference temperature Torg, the first temperature setting Tup, the second temperature setting Tdn, the first time setting Tsb, and the second time setting Tsa, the third time setting Teb, and the fourth time setting Tea.

For example, the temperature reference value output circuit 83 increases the temperature reference value Tref from the timing prior to the timing t1, which is the paper feeding start time, based on the paper feeding start time, the first time setting Tsb, and the second time setting Tsa, the reference temperature Torg, and the first temperature setting Tup. The same control is also performed at the timing t3.

For example, the temperature reference value output circuit 83 decreases the temperature reference value Tref from the timing prior to the timing t2, which is the paper feeding end time, based on the paper feeding end time, the third time setting Teb, the fourth time setting Tea, the reference temperature Torg, and the second temperature setting Tdn. The same control is also performed at the timing t4.

Next, control when the continuous paper feeding is started will be described in detail with reference to FIG. 4. As illustrated in FIG. 4, the print control signal TC is raised from the L level to the H level at timing t11. The paper feeding start time determination circuit 81 supplies timing t13 which is the paper feeding start time, to the temperature reference value output circuit 83, based on the print control signal TC. The timing t13 is the timing when time tconst1 elapsed from the timing t11. The timing t13 corresponds to the timing t1 and the timing t3 in FIG. 3.

The temperature reference value output circuit 83 sets the temperature reference value Tref to a value obtained by adding the first temperature setting Tup to the reference temperature Torg, at the timing t12, which is before the timing t13 by the first time setting Tsb. The temperature reference value output circuit 83 sets the temperature reference value Tref back to the reference temperature Torg at timing t14, which is after the elapse of the second time setting Tsa from the timing t13.

For example, when the function of the temperature reference value output circuit 83 described above is performed by a processor, the program code to be executed by the processor is as follows:

```
If (TC==rise){
t11=t(TC);
t13=t11+tconst1;
t12=t13−Tsb;
t14=t13+Tsa;
}
If(now==time(t12)){
Tref=Torg+Tup;
}
If(now==time(t14)){
Tref=Torg;
}
```

That is, the temperature reference value output circuit 83 outputs a first temperature (Torg+Tup) higher than the reference temperature Torg set in advance to the heater drive circuit 84 as the temperature reference value Tref before a predetermined time when the continuous paper feeding for printing on a plurality of print media P is started, and outputs the reference temperature Torg to the heater driving circuit as the temperature reference value Tref after a predetermined time elapsed. Therefore, the energization power PC increases prior to the timing t13, which is the paper feeding start time. As a result, when the continuous paper passing is started, heat transmitted from the heat roller 71 to the print medium P is compensated, and the temperature of the surface of the heat roller 71 can be prevented from decreasing.

Next, control when the continuous paper feeding ends will be described in detail using FIG. 5. As illustrated in FIG. 5, the print control signal TC falls down from the H level to the L level at timing t21. The paper feeding end time determination circuit 82 supplies timing t23 which is the paper feeding end time, to the temperature reference value output circuit 83, based on the print control information TC. The timing t23 is the timing when time tconst2 elapsed from the timing t21. The timing t23 corresponds to the timing t2 and the timing t4 in FIG. 3.

The temperature reference value output circuit 83 sets the temperature reference value Tref to a value obtained by subtracting the second temperature setting Tdn from the reference temperature Torg at timing t22, which is before the timing t23 by the third time setting Teb. The temperature reference value output circuit 83 sets the temperature reference value Tref back to the reference temperature Torg at the timing t24, which is after the elapse of the fourth time setting Tea from the timing t23.

For example, when the function of the temperature reference value output circuit 83 described above is performed by a processor, the program code to be executed by the processor is as follows:

```
If (TC==fall){
t21=t(TC);
t22=t21+tconst2;
t23=t22−Teb;
t24=t22+Tea;
}
If(now==time(t23)){
Tref=Torg−Tdn;
}
If(now==time(t24)){
Tref=Torg;
}
```

That is, the temperature reference value output circuit 83 outputs a second temperature (Torg−Tdn) lower than the reference temperature Torg to the heater driving circuit 84 as the temperature reference value Tref before a predetermined time elapses from the time when the continuous paper feeding ends, and outputs the reference temperature Torg to the heater drive circuit 84 as the temperature reference value Tref after a predetermined time elapsed. Therefore, the energization power PC decreases prior to the timing t23, which is the paper feeding end time. As a result, when the continuous paper feeding ends, heat transmitted from the heat roller 71 to the print medium P is released, and the temperature of the surface of the heat roller 71 can be prevented from increasing.

As described above, the image forming apparatus 1 includes the heat roller 71 for heating the print medium P and fixing the toner image on the print medium P, the heater 73 for heating the heat roller 71, the heater drive circuit 84 for supplying the energizing power PC to the heater 73 based on the temperature detection signal TS of the heat roller 71 and the temperature reference value Tref, and the target temperature value output circuit 83. The temperature reference value output circuit 83 outputs the first temperature higher than the reference temperature Torg set in advance to the heater drive circuit 84 as the temperature reference value Tref before a predetermined time elapses from the time when the continuous paper feeding for printing on a plurality of print media P is started, and outputs the reference temperature Torg to the heater driving circuit 84 as the temperature reference value Tref after a predetermined time elapsed. Therefore, the temperature of the surface of the heat roller 71 rises immediately before the start of the continuous paper feeding. As a result, when the continuous paper feeding is started, heat transmitted from the heat roller 71 to the print medium P is compensated, and the temperature of the surface of the heat roller 71 can be prevented from decreasing.

The temperature reference value output circuit 83 outputs the second temperature lower than the reference temperature Torg to the heater driving circuit 84 as the temperature reference value Tref before a predetermined time elapses from the time when the continuous paper feeding ends, and outputs the reference temperature Torg to the heater drive circuit 84 as the temperature reference value Tref after a predetermined time elapsed. Therefore, the temperature of the surface of the heat roller 71 decreases immediately before the end of the continuous paper feeding. As a result, when the continuous paper feeding ends, heat transmitted from the heat roller 71 to the print medium P is released, and the temperature of the surface of the heat roller 71 can be prevented from increasing.

The temperature reference value output circuit 83 sets the temperature reference value Tref to the first temperature before the first time setting Tsb elapses from the time when the continuous paper feeding is started, sets the temperature reference value Tref back to the reference temperature Torg after the second time setting Tsa elapses from the continuous paper feeding is started, sets the temperature reference value Tref to the second temperature before the third time setting Teb elapses from the time when the continuous paper feeding ends, and sets the temperature reference value Tref back to the reference temperature Torg after the fourth time setting Tea elapses from the end of the continuous paper feeding. Therefore, the image forming apparatus 1 can prevent the temperature decrease of the surface of the heat roller 71 at the start of the continuous paper feeding, the temperature increase during continuous paper feeding, the temperature rise at the end of the continuous paper feeding, and temperature decrease during the interval.

When the temperature of the surface of the heat roller 71 is too high, the toner is excessively melted, which affects a peeling process after the fixing process. When the temperature of the surface of the heat roller 71 is too low, the toner does not melt and does not fix on paper even if pressure is applied, which causes printing blur. However, according to the control described above, even if there is an interval between continuous paper feeding, it is possible to reduce variation of the temperature of the surface of the heat roller 71. Therefore, print quality of the image fixed to the print medium P can be improved.

The heater drive circuit 84 generates the energization power PC to be supplied to the heater 73 based on a differential value of the difference between the temperature detection signal TS and the temperature reference value Tref. Therefore, the heater drive circuit 84 can supply the energization power PC to the heater 73 so that the temperature detection signal TS follows the temperature reference value Tref.

The difference detection circuit 91 and the PID control circuit 92 of the heater energization control circuit 14 described above may be implemented in any form such as a combination of, an analog circuit, a logical circuit, or a processor and program.

For example, when the difference detection circuit 91 is an analog circuit, the difference detection circuit 91 is a differential amplifier that outputs a difference between two input values. The difference detection circuit 91 may be configured to amplify the output at a predetermined amplification factor to be output.

When the function of the difference detection circuit 91 described above is implemented by software, the program code to be executed by a processor is as follows:

```
[D]=function (TS, Tref, Gain)
{
D=TS−Tref;
D=D*Gain:
}
```

For example, when the PID control circuit 92 is the analog circuit, the PID control circuit 92 comprises a proportional unit, an integrator, a differentiator, and an adder, which adds the outputs of the proportional unit, the integrator, and the differentiator, that are connected in parallel to the difference detection circuit 91.

When the function of the PID control circuit 92 described above is implemented by software, the operation amount M is calculated according to the following mathematical equation by a processor to achieve the function of the difference detection circuit 91:

$$M=Kp\cdot e+Ki\cdot 1/Ti\cdot\int e dt+Kd\cdot Td\cdot de/dt$$

M: operation amount (output of PID control circuit 92)
e: deviation (output of difference detection circuit 91)
Kp: proportional constant of proportional control
Ki: proportional constant of integral control
Kd: proportional constant of differential control
Ti: integration time
Td: differential time
t: time While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A method for controlling an image forming apparatus having a heat roller including a heater, and a heater control circuit, the method comprising:

when printing is to be performed on a print medium, transmitting to the heater control circuit a control signal that indicates when power is to be supplied to the heater; and controlling amount of power supplied to the heater according to the control signal, a target temperature of the heater, and a current temperature of the heater, wherein when printing is to be continuously performed on a plurality of print media, the control signal is transmitted to the heater control circuit so that the heater starts to generate heat a first predetermined time before start of printing, and before an end of the continuous printing, the target temperature is set to a temperature lower than a predetermined temperature that is set when printing is performed on one print medium.

2. The method according to claim 1, further comprising:

determining a timing of the start of printing based on the control signal.

3. The method according to claim 1, further comprising:

determining a timing of the end of printing based on the control signal.

4. The method according to claim 1, further comprising:

maintaining the temperature lower than the predetermined temperature for a predetermined time.

5. The method according to claim 1, further comprising:

determining a difference between the target temperature and the current temperature.

6. The method according to claim 5, wherein the amount of power is controlled according to a derivative value of the difference output from the difference circuit.

7. The method according to claim 6, wherein the amount of power is controlled by switching the power on and off according to a cycle of an AC voltage supplied from an external power source.

8. An image forming apparatus comprising:

a heat roller comprising a heater configured to generate heat to fix a toner image on a print medium;

a system controller configured to transmit, when printing is to be performed on a print medium, a control signal that indicates when power is to be supplied to the heater; and a heater control circuit configured to control amount of power supplied to the heater according to the control signal, a target temperature of the heater, and a current temperature of the heater, wherein when printing is to be continuously performed on a plurality of print media, the system controller transmits the control signal to the heater control circuit a first predetermined time before start of printing, and before an end of the continuous printing, the heater control circuit sets the target temperature to a temperature lower than a predetermined temperature that is set when printing is performed on one print medium.

9. The apparatus according to claim 8, wherein the heater control circuit comprises a determination circuit configured to determine a timing of the start of printing based on the control signal.

10. The apparatus according to claim 8, wherein the heater control circuit comprises a determination circuit configured to determine a timing of the end of printing based on the control signal.

11. The apparatus according to claim 8, wherein the heater control circuit is configured to maintain the temperature lower than the predetermined temperature for a predetermined time.

12. The apparatus according to claim 8, wherein the heater control circuit comprises a difference circuit configured to output a difference between the target temperature and the current temperature.

13. The apparatus according to claim 8, wherein the heater control circuit is configured to control the amount of power according to a derivative value of the difference output from the difference circuit.

14. The apparatus according to claim 13, wherein the heater control circuit is configured to control the amount of power by switching the power on and off according to a cycle of an AC voltage supplied from an external power source.

* * * * *